US005309686A

United States Patent [19]

Underwood et al.

[11] Patent Number: 5,309,686

[45] Date of Patent: May 10, 1994

[54] WORK SPACE PARTITION SYSTEM

[75] Inventors: Robert A. Underwood, Huntingburg; Jay M. Henriott, Jasper, both of Ind.

[73] Assignee: Kimball International, Inc., Jasper, Ind.

[21] Appl. No.: 837,725

[22] Filed: Feb. 19, 1992

[51] Int. Cl.[5] ..... E04H 6/06; E04B 1/346

[52] U.S. Cl. ..... 52/29; 52/36.5; 52/64; 52/238.1; 52/239; 160/135; 312/223.3

[58] Field of Search ..... 52/29, 36.5, 238.1, 52/239, 64; 160/135; 49/404; 312/223.3, 246

[56] References Cited

U.S. PATENT DOCUMENTS

| | | | |
|---|---|---|---|
| 1,745,402 | 2/1930 | Bülek | 312/246 |
| 2,499,240 | 2/1950 | Aiken | 312/246 |
| 3,290,846 | 12/1966 | Mader et al. . | |
| 3,778,939 | 12/1973 | Nelsson . | |
| 4,083,157 | 4/1978 | Anthonioz . | |
| 4,180,298 | 12/1979 | Borgerson, Jr. | 312/246 |
| 4,459,790 | 7/1984 | Vermillion . | |
| 4,716,699 | 1/1988 | Crossman et al. . | |
| 4,876,835 | 10/1989 | Kelley et al. . | |
| 4,907,384 | 3/1990 | Underwood . | |
| 4,944,122 | 7/1990 | Wendt . | |
| 5,010,702 | 4/1991 | Daw et al. . | |

FOREIGN PATENT DOCUMENTS

| | | |
|---|---|---|
| 0241344 | 10/1987 | European Pat. Off. . |
| 2118097 | 12/1971 | France . |
| 2579879 | 4/1985 | France . |
| 1098851 | 11/1964 | United Kingdom . |

*Primary Examiner*—Carl D. Friedman
*Assistant Examiner*—Christopher T. Kent
*Attorney, Agent, or Firm*—Baker & Daniels

[57] ABSTRACT

A work space management system for creating work areas including two horizontal elongate tracks attached to a permanent wall with a decorative wall tile disposed therebetween and an office partition panel attached to the tracks at variably selectable positions for defining and partitioning the work areas. Overhead modular storage units and work surfaces may attach alternatively to the panels and tracks at any point and may be removed and relocated as needed. The brackets attaching the modular furniture to the track include an anti-dislodgement tang preventing disconnection of the furniture units from the track by only vertical movement.

14 Claims, 10 Drawing Sheets

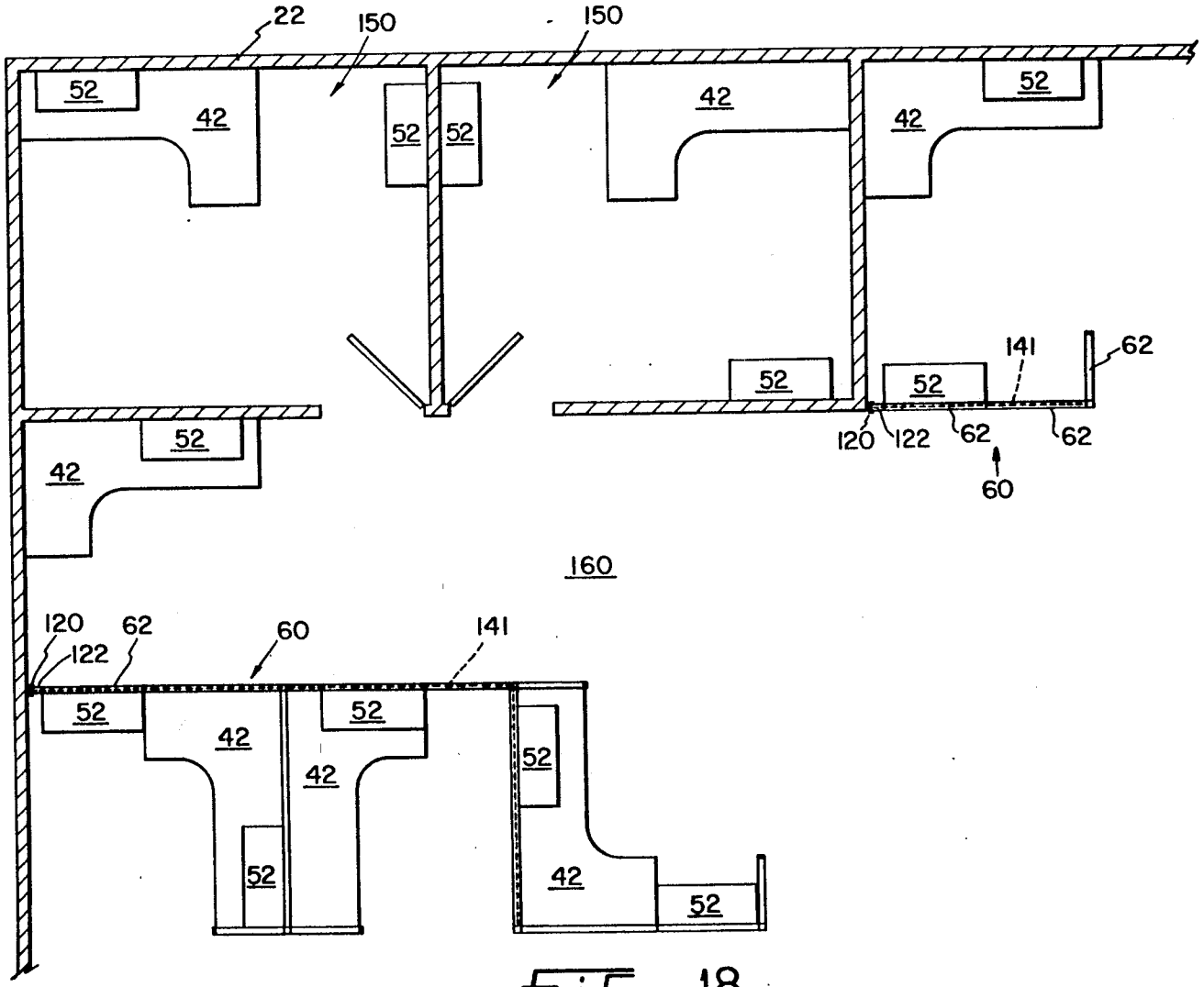
22
150
150
52
42
52
52
42
52
42
52
42

WORK SPACE PARTITION SYSTEM

BACKGROUND OF THE INVENTION

The present invention relates generally to office systems and, more particularly, to such office systems having movable partitions and modular furniture units.

Current changes in office environments have created a transition from private fixed wall offices to a need for conference areas. Private offices are now a meeting area for office personnel, and office partition systems have become universally employed in offices.

Office furniture includes components such as desks, credenzas, storage modules and other office equipment. Normally it is not possible to use the same office furniture interchangeably in both a private, fixed wall office and an open office scheme. In the prior art, most office furniture was made for either a fixed wall office or an open office environment. The open office furniture was not able to be interchanged between the two environments because it was designed to attach to particularly sized office panels. In these open offices, the partitions included vertical channel members with slots into which the office furniture would connect and hang much like those shown in U.S. Pat. No. 4,907,384 assigned to the assignee of the present invention. These vertical channels are spaced a fixed distance apart allowing only similarly spaced office furniture to attach. Private offices normally do not have the vertical channels for attaching furniture. There is a particular need to reduce the types of office furniture in order to achieve flexibility and economies in manufacturing.

Rapidly changing business conditions have resulted in constant changes in the work force of many offices. In prior art systems, the integration and physical layout of open office schemes and private office schemes are difficult to adapt and change. Also, it has been difficult to supply power to open office partition schemes since these systems often stand away from pre-existing exterior walls from where power is normally supplied. This has necessitated power cords running under floors or through ceiling tiles to electrify the free standing partitions of open office systems.

Prior art office componentry in open office panel systems is limited in that certain components may be attached only at specific places on the system because of the location the vertical channels or because of strength limitations of the system. Open office systems and private fixed wall offices have not had integrated, consistent and complimentary office work space partition systems.

Thus there is a need for an office system which is flexible, visually appealing, and adaptable to changing office requirements.

SUMMARY OF THE INVENTION

The present invention overcomes the disadvantages of the above-described prior art office systems by providing an improved office work space management system capable of supporting office componentry and open office partition structures along an existing wall.

Generally, the present invention provides a work space partition system for defining office work areas. The system includes an elongate mounting track attached horizontally to an existing wall with modular furniture units mounted to and supported by the track. An office partition panel is slidably attached, extending substantially perpendicular from the track at selectable positions along the wall for defining and partitioning the work space.

In one form of the invention, two mounting tracks are attached horizontally onto an existing wall with a wall tile disposed between the tracks such that the tile covers the wall. Brackets are included for connecting one or more office partition panels substantially perpendicularly to the track at slidably selectable positions for defining and partitioning the work space. A plurality of modular furniture units are included in the system mountable on the track or panel by brackets.

In another aspect of the invention, edge caps cover the wall tile edges so that parallel seams may be created between wall tiles even if the wall tiles have irregular edges.

In another form of the invention, the work space management system includes a mounting means for attachment of furniture units to the horizontal track. The mounting means includes a plate having a flange attaching to the bottom edge of a track with an upstanding anti-dislodgement tang inserted behind a top edge of the track so that removal of the mounting means and therefore furniture units from the track by vertical movement is prevented.

In another form of the invention, a cord manager is incorporated so that power and other types of cords may be concealed from view. The cord manager is formed from a conduit attached vertically to a wall tile between a storage unit and work surface unit. The cord manager is attached to a tile by an edge piece of the conduit interfitting between a tile edge and an end cap.

An advantage of the work space partition system of the present invention, according to one form thereof, is that of merging a fixed wall based office system with an open office panel system, thereby reducing the number of office components.

Another advantage of the work space system of the present invention is that the physical layout of an office, either private or open, may be changed simply and easily at any time. An indefinite number of office floor plans may be created in an open type office environment by the present system.

Yet another advantage of the work space system of the present invention, in accordance with one form thereof, is of permitting easy connection of electrical power to open office space systems via the wall panel attached to the track.

A still further advantage of the work space system of the present invention is that of permitting a single line of furniture adaptable to either open office or private fixed wall office configurations for use in the system. These units may attach anywhere along the track.

The invention, in one form thereof, provides a workspace partition system for defining a work area. The system comprises existing permanent walls standing substantially vertical relative to a floor with an elongate mounting track attached generally horizontally on the walls. A movable office partition panel, supported by the floor, is attached substantially perpendicular to the track at variably selectable positions for defining and partitioning the work area. At least one modular furniture is mounted to and supported by either the track or panel. The office partition panel is positionable anywhere along the track.

In one aspect of the previously described form of the invention, a second elongate mounting track is attached horizontally on the wall below the first track. A wall tile is disposed between the tracks to thereby cover the wall. A mounting means is included for attaching furniture units including work surface units and storage units to the system. Storage units may be attached to the first track while work surface units may attach to the second track. A cord manager, attached vertically to a tile, may conceal power and data cords within the work area.

In accord with another aspect of the invention, a mounting means for mounting the modular furniture units onto the track is provided. The mounting means may include a bracket with a flange portion for engaging a bottom edge of the mounting track. The bracket also includes an opposing anti-dislodgement tang slid up behind a top edge of the mounting track. The bracket may slide along the track to any position but is prevented from separating from the track by vertical movement, by the antidislodgement tang.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 18 is a plan view of a possible configuration of the present work space partition system utilized in both a fixed wall and an open office environment;

Figure 1:
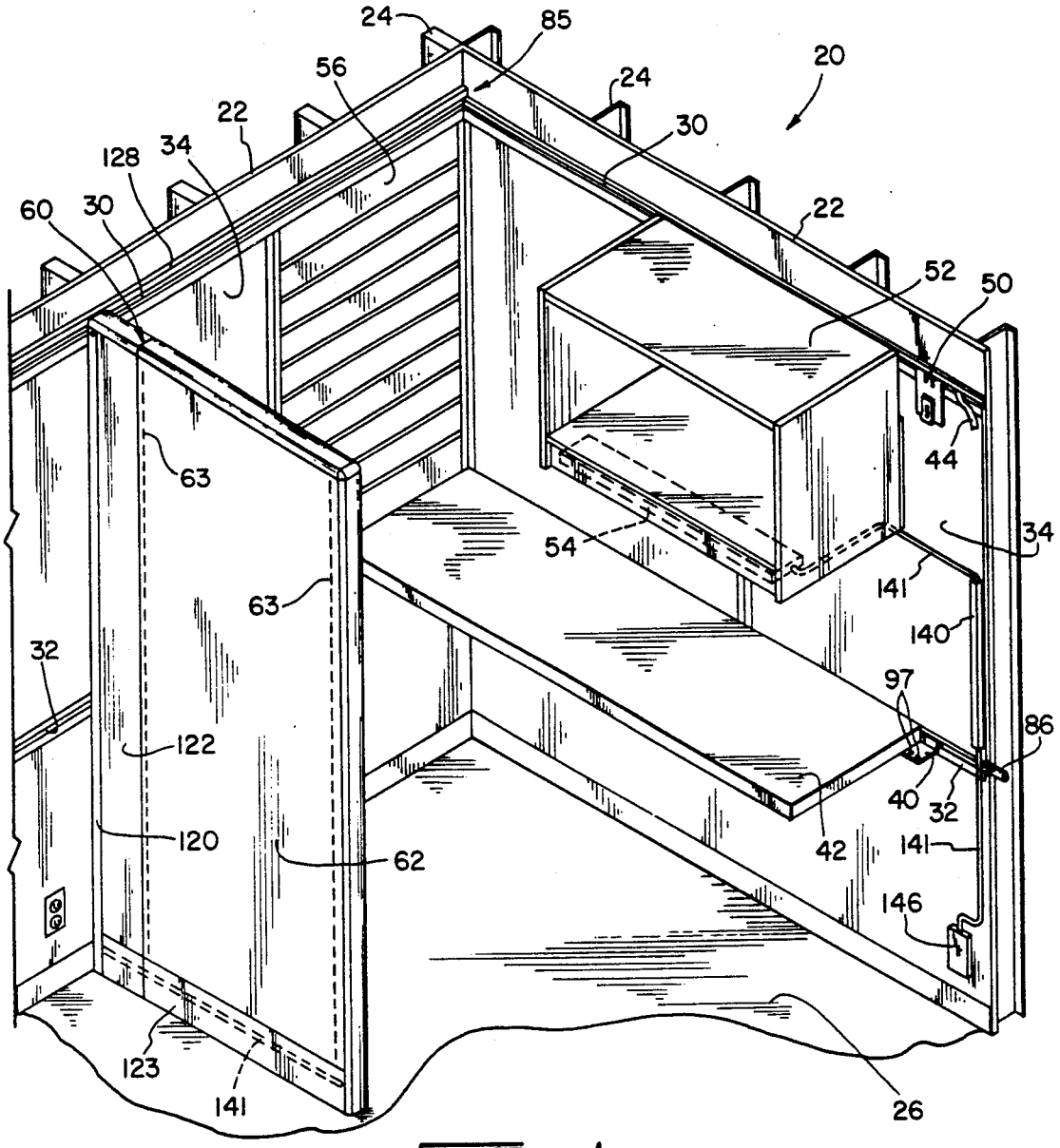
FIG. 1 is a perspective view of the work space management system of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring now to FIG. 1, there is shown a work space partition system 20 in accordance to the present invention. System 20 includes existing permanent walls 22 attached to wall studs 24 at standard increments as is known in normal construction techniques. Both wall 22 and studs 24 stand substantially vertical from floor 26. Upper and lower elongate mounting tracks 30 and 32 are attached horizontally to wall 22. Tracks 30 and 32 may be attached to wall 22 by bolts, screws, or other suitable attachment methods. A wall tile 34 is disposed between upper track 30 and lower track 32 to cover wall 22. Wall tiles 34 are removable or interchangeable without removing tracks 30 and 32. Tiles 34 may be constructed of wood, plastic, fabric covered press board and other materials in an assortment of colors.

FIG. 1 shows a work surface bracket 40 attached to lower track 32. A work surface 42 may be attached by screws (not shown) to work surface bracket 40 creating a desk top in the office environment.

Overhead bracket 50 slidingly attaches to upper track 30 permitting modular furniture unit 52 to attach to the track. Modular furniture unit 52 may comprise an overhead case storage unit, bookcase, or other common office furniture.

Instead of wall tiles 34 being disposed between tracks 30 and 32, a slat tile 56 may be alternatively inserted permitting small office equipment and other office items to be hung from system 20. A panel unit 60 is shown attached to the work space management system 20 by tracks 30 and 32.

Figure 2:
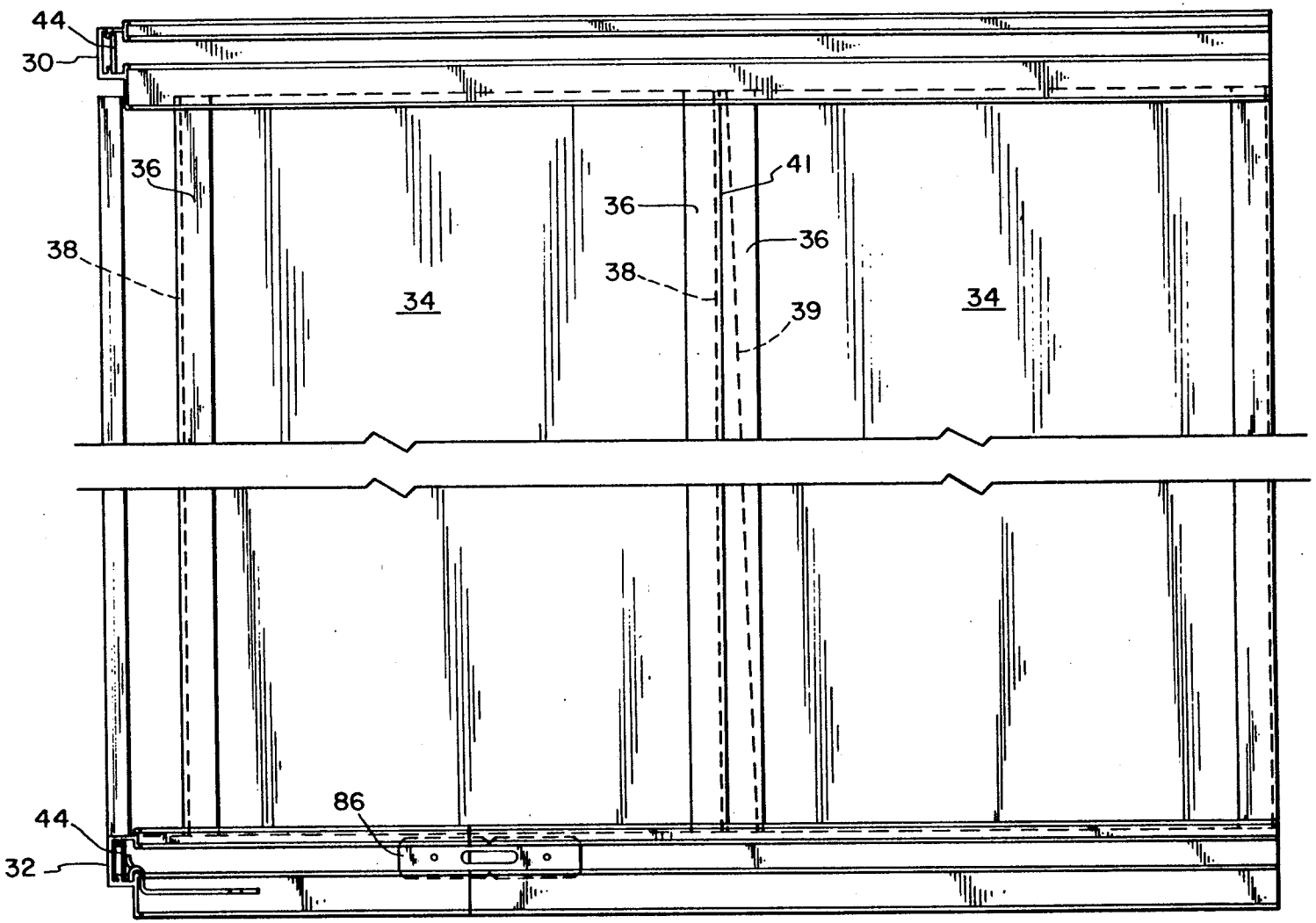
FIG. 2 is a front elevational view of the work space management system of the present invention.

Another view of the work space partition system 20 is shown in FIG. 2 particularly highlighting wall tiles 34 disposed between tracks 30 and 32. Wall tiles 34 are supported between tracks 30 and 32 by track edge 66 and behind track front faces 72 and 74 respectively. Normally, wall tiles 34 are manufactured in standard sizes anywhere from 6 inches to 96 inches in width.

Wall tile 34 is purposely undercut by approximately $\frac{1}{8}$ inch on each vertical edge 38 permitting room for adjustment of edge caps 36. Each vertical edge 38 is covered by a U-shaped channel or edge cap 36 to create parallel seams 41 between each wall tile 34. Edge caps 36 also provide visual concealment of irregular edges such as an irregular edge 39 (FIG. 2) so that even wall tiles 34 that are not square with parallel sides may be utilized and made to appear square and even by adjustment of edge caps 36.

Correspondingly, wall tiles 34 may be slightly narrower than needed to cover a desired area of wall 22.

Edge caps 36 may be incrementally slid horizontally on tiles 34 to take up the required wall width to be covered. These edge caps 36 also supply additional vertical rigidity to tiles 34 preventing tiles 34 from bowing out from wall 22. In this manner, any fluctuation in the size of tiles 34 caused by temperature and humidity are compensated for while keeping tiles 34 flat against wall 22.

Figure 3:
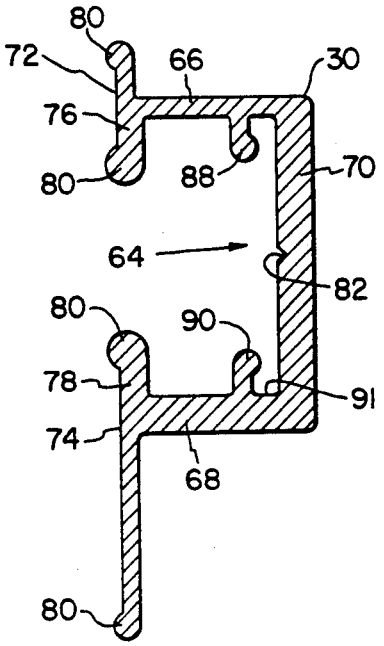
FIG. 3 is an elevational end view of the track of the work space management system of FIG. 1.

FIG. 3 shows an end view of track 30 which is identical to track 32. Track 30 comprises an extruded metal rectangular channel 64 created by an upper edge 66 and lower edge 68 connected to a back wall 70. Upper and lower face surfaces 72 and 74 are attached to respective upper edge 66 and lower edge 68, parallel to back wall 70. Face surfaces 72 and 74 create upper and lower front edges 76 and 78 respectively. Upper and lower face surfaces 72 and 74 include rounded protruding end portions 80 that blunt the edges of face surfaces 72 and 74 while also reducing accidental scuffing of face surfaces 72 and 74 during system installation and operation. Guide portions 88 and 90 are formed inside channel 64 along upper and lower edges 66 and 68 respectively forming a connection passage 91. When office system components are slid along track 30, end portions 80 are the only points of track 30 in contact that may be scarred or scratched since they protrude away from track 30.

Attachment holes 84 for attaching track to walls 22 will be drilled into the track at the job site by the system installer. This permits tracks to be attached to walls 22 with any type of stud spacing. A V-shaped groove 82 along back wall 70 permits a drill bit to be centered within channel 64 easily and quickly to drill a centered mounting hole 84 as shown in FIG. 7.

Figure 5:
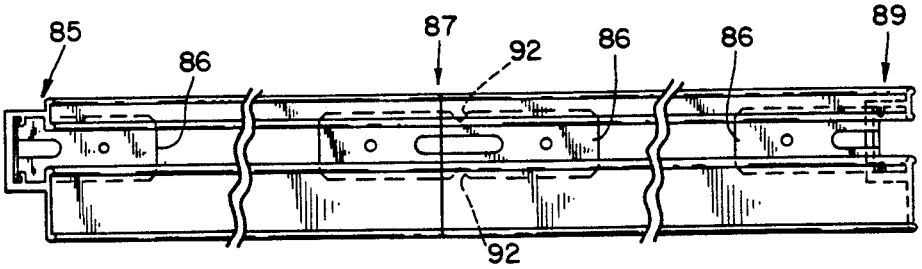
FIG. 5 is an elevational view of the track connectors of FIG. 4.
Figure 6:
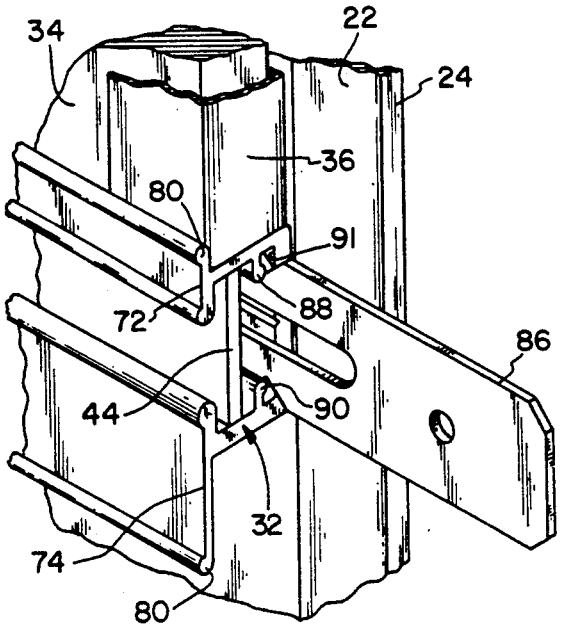
FIG. 6 is a perspective view of a track with a splice connector inserted therein for connecting segments of track.
Figure 4:
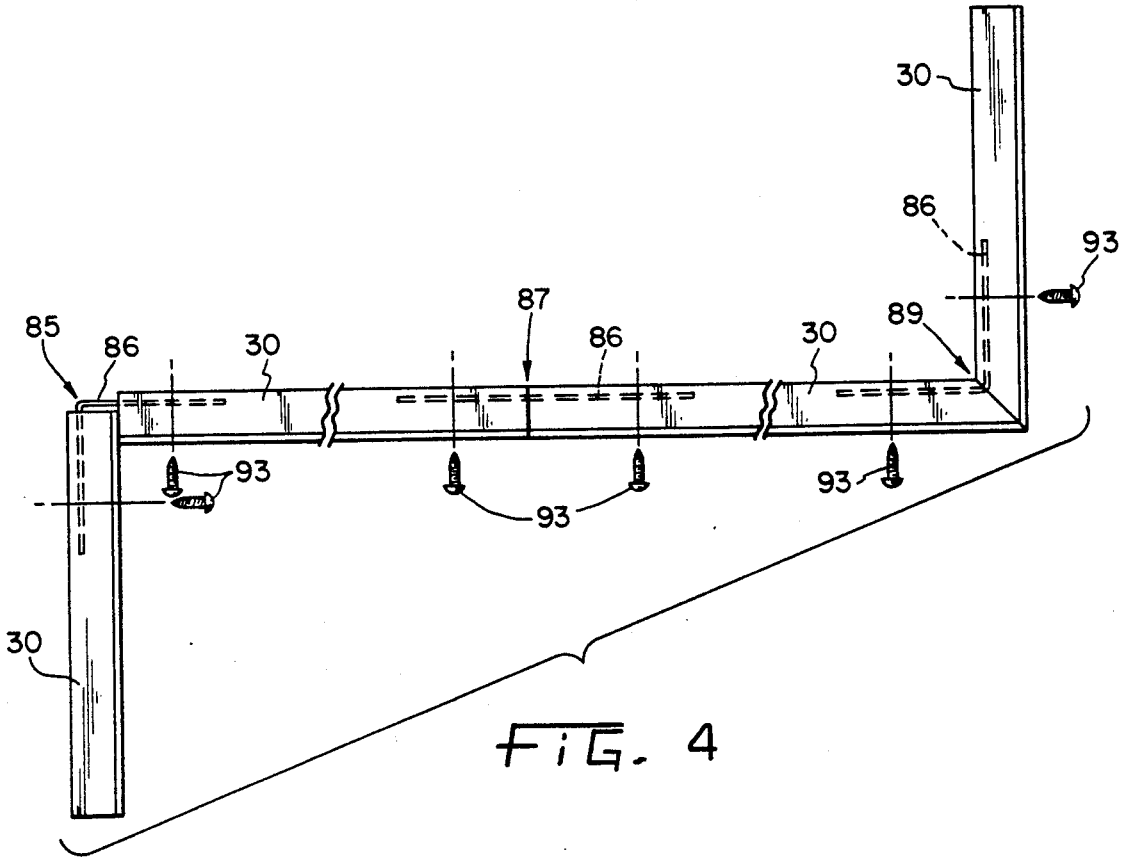
FIG. 4 is a top view of track connected together.

As shown in FIGS. 4 and 5, tracks may be attached together by a connection means such as a splice plate 86 inserted into connection passages 91. Splice plate 86 is generally a rectangular metal plate constructed of a malleable metal such as aluminum or steel. Plate 86 is malleable enough for bending in order to connect track 30 around corners or angles. To promote the adjustable angular bending, plate 86 includes 90° notches 92 on opposite sides creating a weak spot or bend line. As shown in FIG. 4, splice plate 86 may connect track members 30 together in either a butt joint connection 85, inline splice connection 87, or a mitered outside corner connection 89. These types of connections allow for quick system installation. Splice plate 86 interfits track 30 between guide members 88 and 90 and back wall 70 into connection passage 91, and are attached to tracks by screws 93. FIG. 6 shows a perspective view of splice plate 86 inserted into connection passage 91 in track 32.

Figure 13:
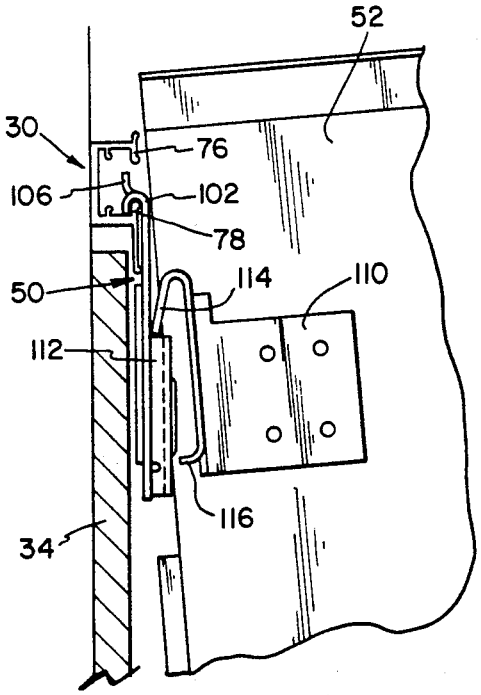
FIG. 13 is a side elevational view of the overhead bracket of FIG. 11 attached to a track, particularly showing the attachment of an overhead storage cabinet.

Also shown in FIG. 6 is a wall tile 34 disposed above track 32 resting on upper edge 66 behind upper face surface 72. Conversely, as shown in FIG. 13, tile 34 is disposed beneath track 30 under lower edge 68 and behind lower face surface 74. In this way, tile 34 is retained against wall 22.

Figure 7:
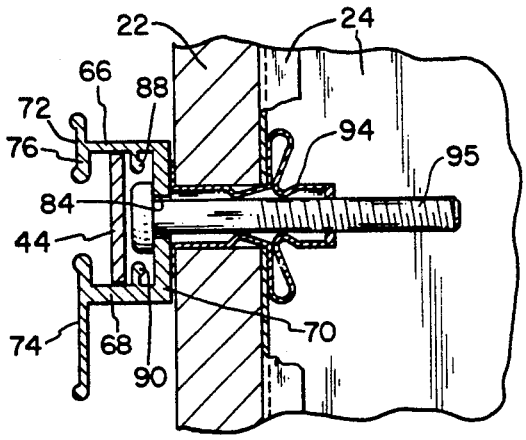
FIG. 7 is a sectional view showing a track section attached to an existing fixed wall.

Tracks 30 and 32 are attached to walls 22 by means of a fastener such as a molley anchor 94 and screw 95 (FIG. 7). Other fasteners may be utilized to attach track 30 to wall 22 such as screws or lead anchors. Within tracks 30 and 32 is disposed a concealment means or blinder 44, concealing how tracks 30 and 32 are attached to wall 22. As shown in FIGS. 6 and 7, blinder 44 is constructed from a supple, cloth-like material disposed between front edges 76 and 78 and guide portions 88 and 90. For example, felt may be used as the blinder material. Blinder 44 is generally flat. Insertion by hand of blinder 44 into track 30 is possible since the cloth material is supple. Blinder 44 may be colored or dyed to color co-ordinate with the track or wall tiles 34.

Figure 8:
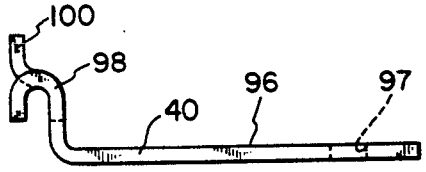
FIG. 8 is an elevational view of a work surface bracket.
Figure 10:
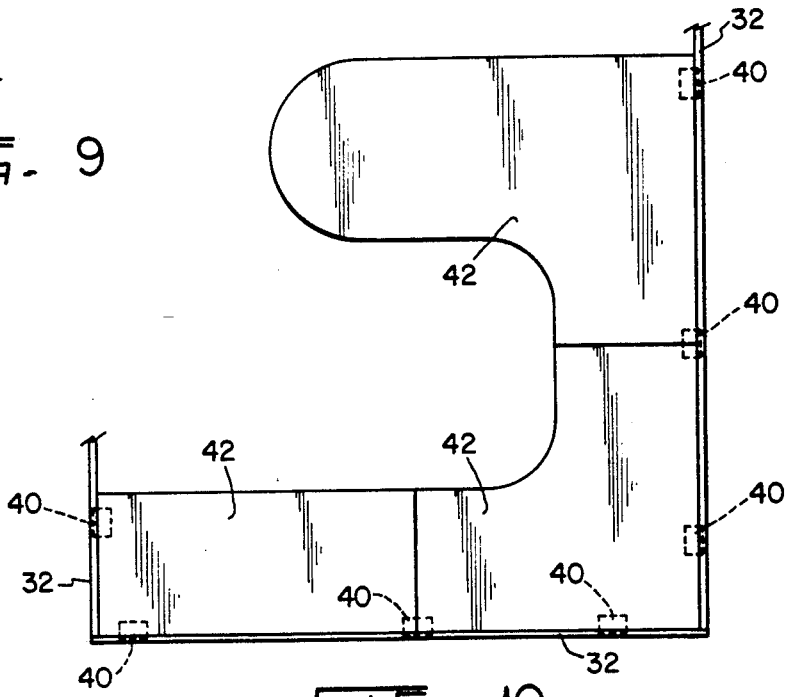
FIG. 10 is a top view of the work space partition system showing the placement of work surface brackets along sections of track.
Figure 11:
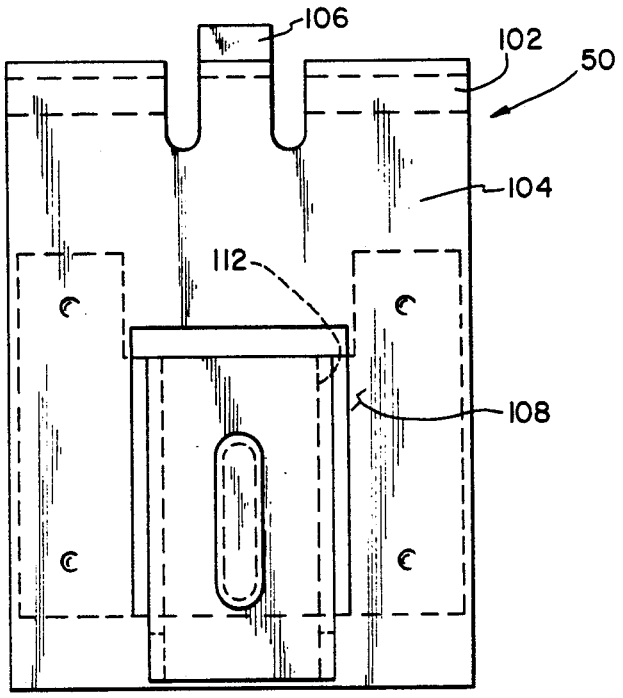
FIG. 11 is a front elevational view of an overhead bracket used in attaching modular furniture units to the track.

Work surfaces 42 of the present system are attached to track 32 by mean of a work surface bracket 40. As shown in FIG. 8, work surface bracket 40 includes a flat portion 96 attached to a J-shaped flange 98. Disposed in J-shaped flange 98 is an opposing anti-dislodgement tang 100. Tang 100 helps to prevent separation of bracket 40 from track 32 by requiring more than only vertical movement to separate the bracket 40 and track 32. Bracket 40 also includes four holes 97, two of which are shown in FIG. 1. Holes 97 permit screws or other fasteners to attach work surface 42 to bracket 40. Hole 97 also permits bracket 40 to act as a tying member between two work surfaces 42, as shown in FIG. 10, by connecting two work surfaces 42 to the same bracket 40.

Figure 9:
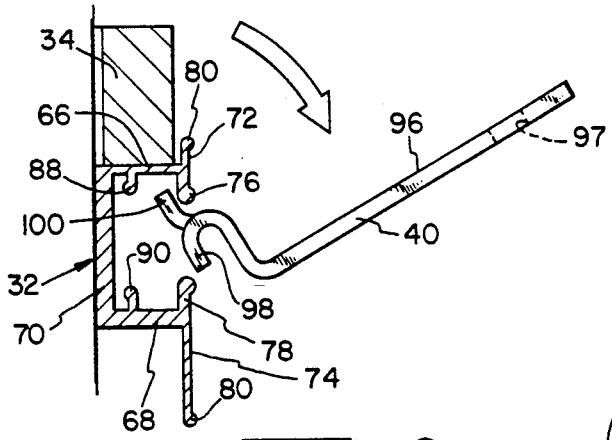
FIG. 9 is a sectional view of a track section showing the insertion of a work surface bracket.

Work surface bracket 40 attaches to track 32 as shown in FIG. 9. Anti-dislodgement tang 100 is first inserted into channel 64 and behind upper front edge 76. Bracket 40 is then swung down in the direction of the arrow in FIG. 9 until flange 98 is seated over lower front edge 78. At this point, bracket 40 is now attached to track 32 and may be slid horizontally anywhere along the length of track 32. Flat portion 96 of bracket 40 is substantially parallel to floor 26 permitting mounting of work surface 42. The end of work surface 42 opposite bracket 40 may be supported by a pedestal (not shown) or other means to provide further vertical support of work surface 42 while bracket 40 keeps work surface 42 in place. As shown in FIGS. 1 and 10, brackets 40 attach to work surface 42.

Anti-dislodgement tang 100 prevents removal by only vertical movement of work surface 42 and bracket 40 from track 32 by maintaining the J-shaped flange portion 98 within channel 64 upon an impact or bump. An impact or vertical lifting force applied to bracket 40 will cause tang 100 to slide behind and catch upper front edge 76 thereby preventing bracket 40 from being released from track 32. For removal of bracket 40 from track 32, bracket 40 must be tilted upwardly and rotated so that J-shaped flange portion 98 may escape from channel 64. FIG. 10 shows a plan view of a modular office layout showing a plurality of brackets 42 attaching different shaped work surfaces 42 to track 32.

Figure 12:
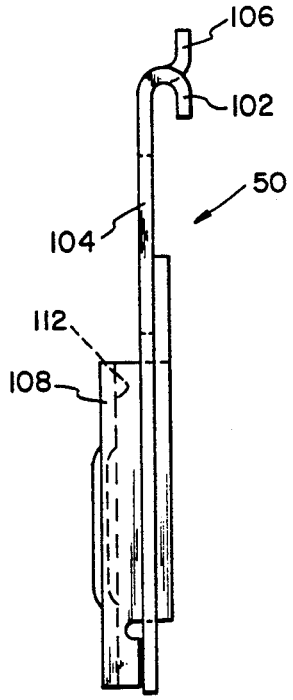
FIG. 12 is a side elevational view of the overhead bracket of FIG. 11.

Overhead and/or modular furniture units 52 are attached to track 30 by means of overhead bracket 50. As shown in FIG. 12, overhead bracket 50 includes a J-shaped flange 102 attached to a rectangular base member 104. An anti-dislodgement tang 106 is disposed within J-shaped flange 102 but curving in an opposite direction. Attached to base member 104 is a hitch member 108 that permits a hook member 110 connected to furniture unit 52 to interfit and secure.

Overhead bracket 50 attaches to track 30 in substantially the same way as work surface bracket 40 attaches to track 32. To attach overhead bracket 50 to track 30, first, anti-dislodgement tang 106 is inserted into channel 64 and behind upper front edge 76. Overhead bracket 50 is then rotated downwardly toward wall tile 34 positioning J-shaped flange 102 over lower front edge 78. In this way, base member 104 hangs from track 30 substantially flat against wall tile 34. Tang 106 prevents separation of bracket 50 from track 30 during sudden vertical movement of bracket 50.

Hook member 110 attached to furniture unit 52 is then inserted into hitch member 108 of hanging bracket 50. Hitch member 108 contains a hollow channel 112 into which hook member 110 is received. As shown in FIG. 13, hook member 110 includes a top supporting hook 114 that is interfit into channel 112 to support furniture unit on bracket 50. Hook member 110 also includes a lower hook member 116 which acts as an anti-dislodgement tang that attaches under channel 112 to prevent removal of hook member 110 from bracket 50 by only vertical movement.

In addition to the requirement for work surfaces and furniture units, office spaces are at times constructed in buildings with large open areas. These large areas need to be partitioned to allow office personnel moderate levels of privacy and a quiet environment in which to work. As shown in FIGS. 1 and 18, an office partition means such as a panel unit 60 may be attached to tracks 30 and 32 to partition the office space in an efficient manner and integrate the open office with a fixed wall office environment.

Figure 14:
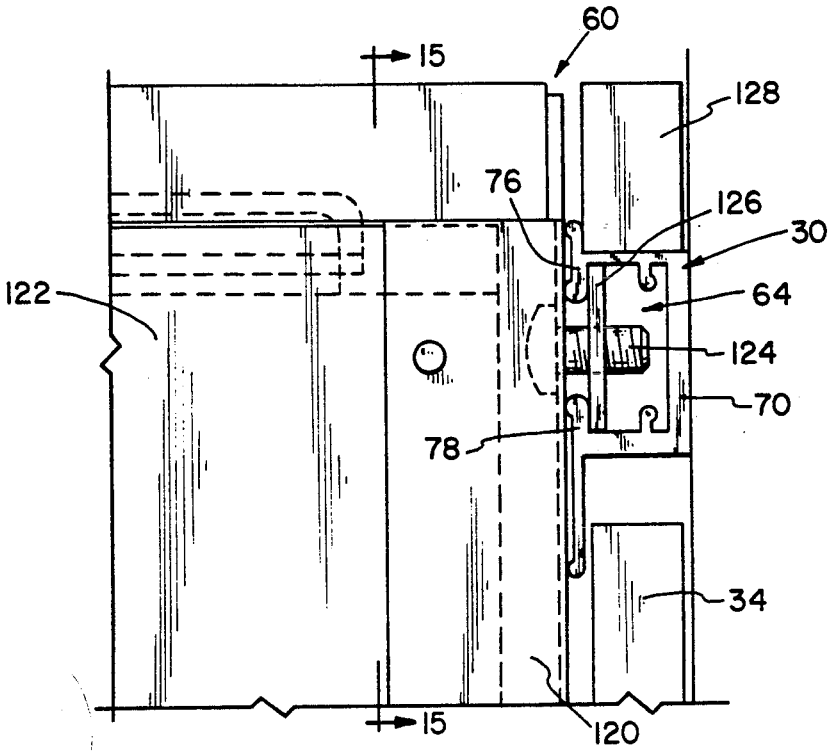
FIG. 14 is a sectional view of an office panel attached perpendicular to the track section.
Figure 15:
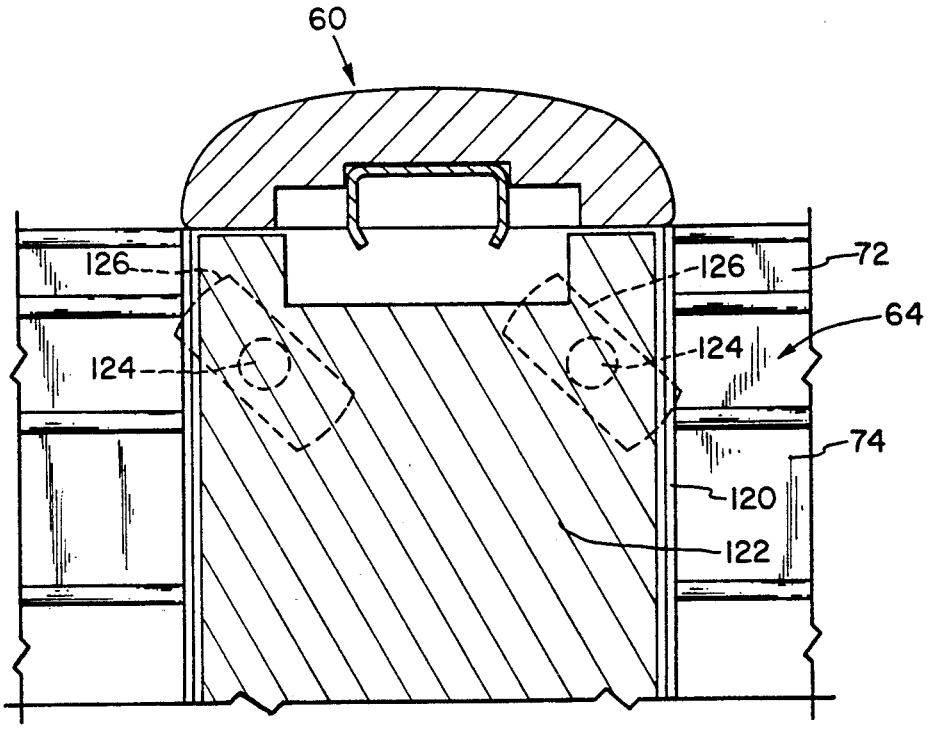
FIG. 15 is a sectional view of the office panel of FIG. 14 taken along line 15—15 and viewed in the direction of the arrows.
Figure 19:
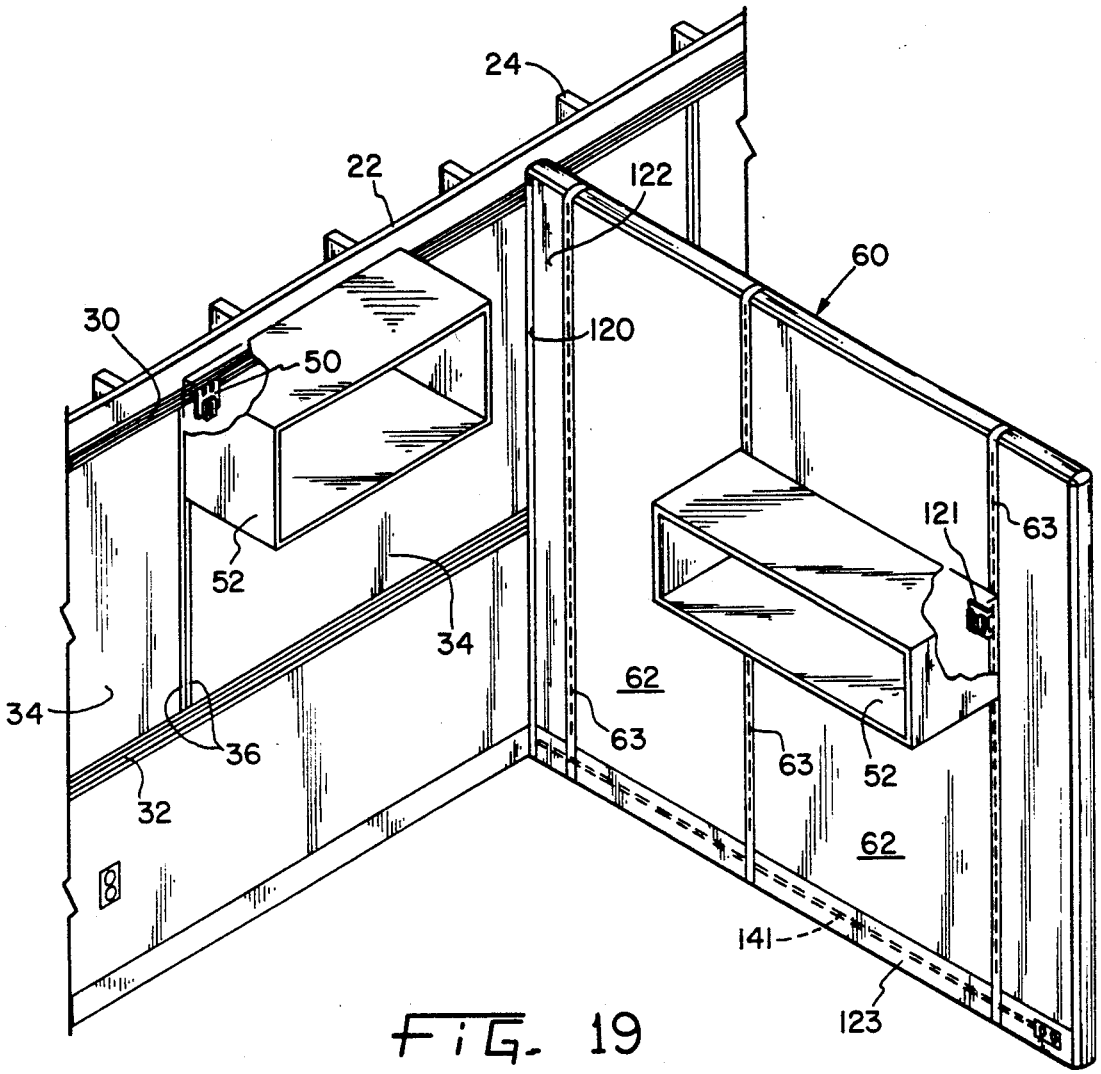
FIG. 19 is a perspective view of the work space partition system showing an overhead storage unit attached to a panel and a track.
Figure 20:
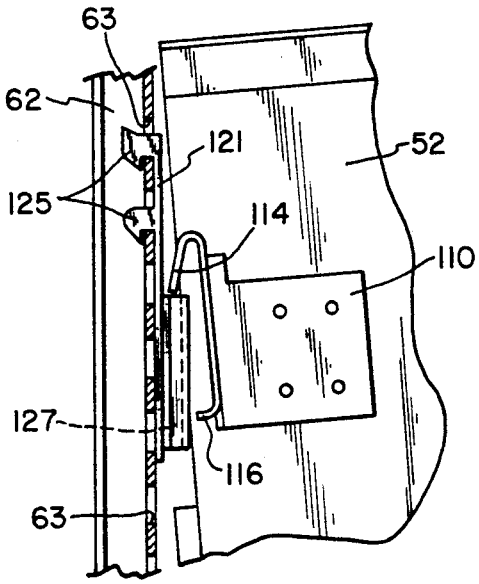
FIG. 20 is an elevational view of a bracket used to connect an overhead storage unit to a panel.
Figure 21:
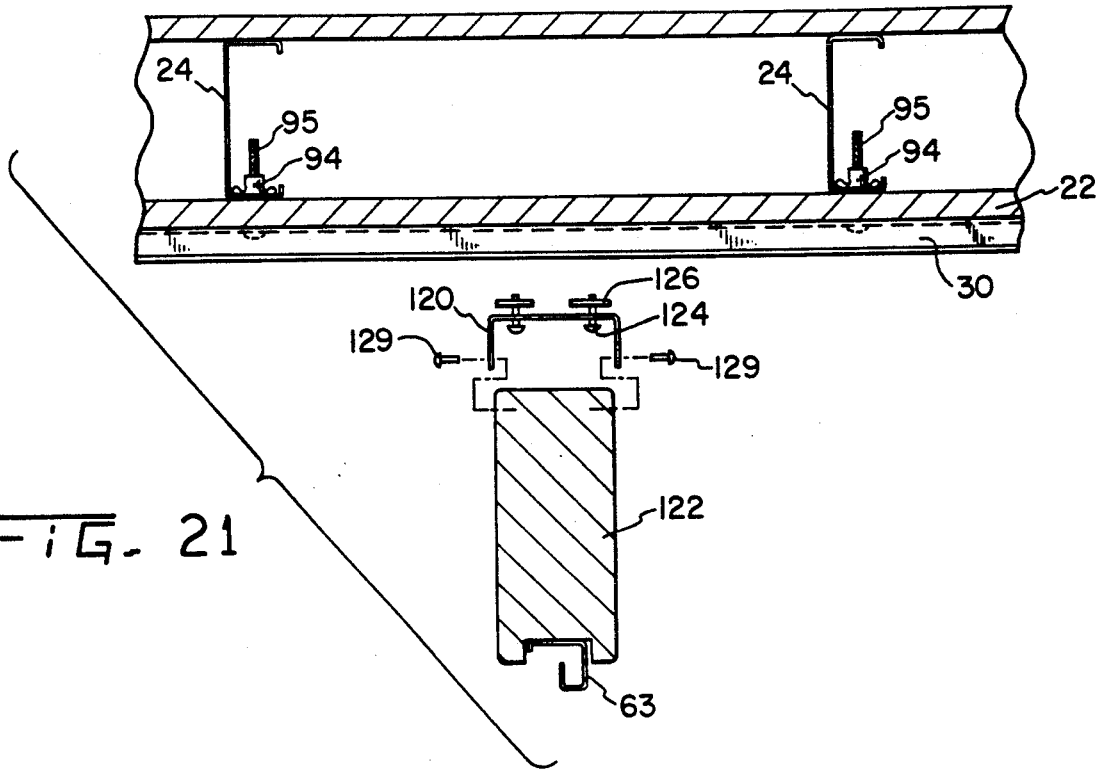
FIG. 21 is a plan view of the office partition means showing the attachment of the starter channel to a transition panel.
Figure 22:
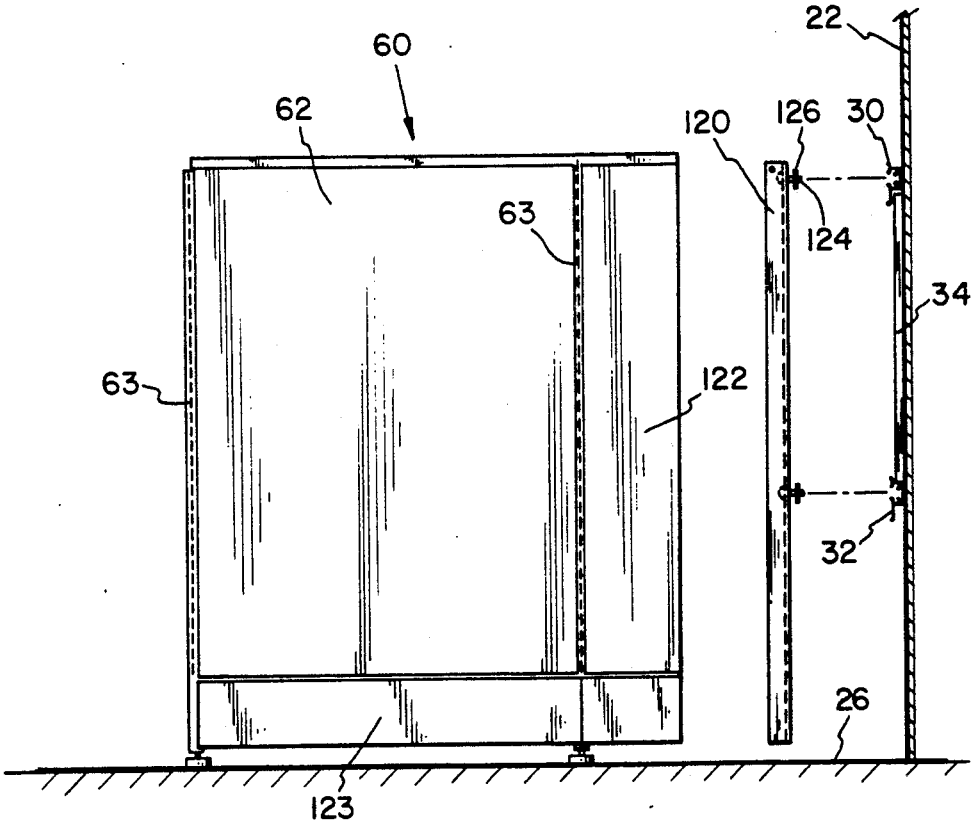
FIG. 22 is a side elevational view of the connection of a panel unit to the track.

As shown in FIGS. 14, 15 and 19, office partition means such as panel unit 60 is attached to a track 30. Panel unit 60 is constructed from a panel 62 with starter channel 120 and a transition panel 122. Side edges of starter channel 120 attach to the sides of transition panel 122 while the top and bottom of transition panel 122 attaches to the top and bottom of panel 62. Transition panel 122 includes a row of vertical slots 63 for attachment of a bracket 121 to support office furniture. An example of a panel unit 60 with slots 63 and top and bottom connection bracketry is shown in U.S. Pat. No. 4,907,384 assigned to the assignee of the present invention and explicitly incorporated herein by reference.

As shown in FIG. 19, modular furniture units such as overhead storage components may be hung from panel unit 60. A panel bracket 121 includes hooks 125 that clip into slots 63 in panel unit 60 (FIG. 19).

Hook member 110 attached to furniture unit 52 is inserted into a hollow channel 127 in bracket 121 to permit furniture panel unit 52 to hang from panel unit 60 via panel bracket 121. Hook member 110 permits the same furniture unit 52 to attach to either panel unit 60 or tracks 30 and 32. This interchangability permits standardized office furniture used in current open office panel systems to be used in fixed wall applications. Integration of an open office into a fixed wall office environment is therefor possible with the present system.

Panel unit 60 is attached to track members 30 and 32 by bolts 124 attaching through holes in back wall of starter channel 120 into oblong retainers or nuts 126 disposed in channel 64 behind upper and lower front edges 76 and 78. Retainers 126 are elongated so that they can be inserted and removed but do not rotate within channel 64 when tightened. By this arrangement, the office partition panel unit 60 may slide and be positionable anywhere along the track.

Panel unit 60 is also supported by floor 26 and attached substantially perpendicular to track 30 and 32 at any selected position for defining and partitioning the work area. Included within panel unit 60 is a bottom raceway 123 for conducting power and data cables 141 from a location near wall 22 into the center of the office space. Depending upon the height of panel unit 60, unit 60 may be attached to one or both tracks 30 and 32. As shown in FIG. 14, a filler member 128 may be located above track 30, even with the top of panel unit 60, to permit a neat and even finish along wall 22.

Figure 16:
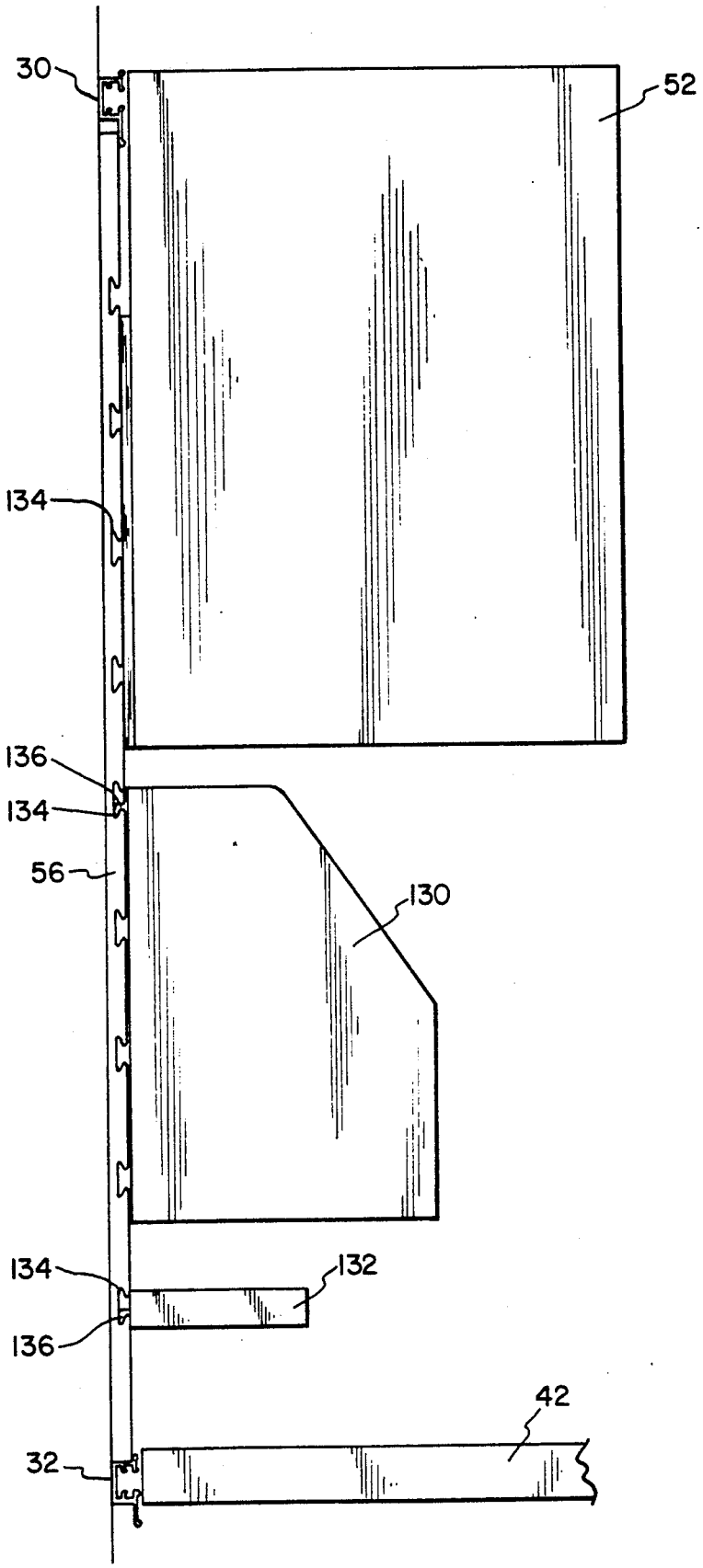
FIG. 16 is an elevational view of a slat tile of FIG. 1 with additional modular furniture units mounted thereon.

In addition to the system 20 utilizing decorative wall tiles 34 produced in the plurality of colors, other types of wall tiles may be used. As shown in FIG. 1, a slat tile 56 may be disposed between tracks 30 and 32. Slat tile 56 permits various office componentry to be hung in the office work space. FIG. 16 shows a sectional view of slat tile 56 in which, for example, a hanging file unit 130 and an ashtray 132 are represented hanging from machined slots 134 of slat tile 56 by brackets 136.

Figure 17:
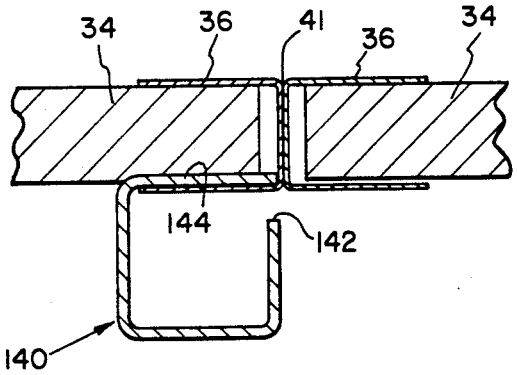
FIG. 17 is a sectional view of the cord manager unit of the present invention.

Some modular furniture units 52 may include a work surface task lighting unit 54 or other appliances that require electricity. To permit power or data cables to be routed and controlled, a cord manager 140, shown in FIG. 1, manages and conceals power and data cords 141 running from furniture unit 52 down past and under work surface 42 to a junction box 146 or other wire connector disposed in wall 22. As shown in FIG. 17, cord manager 140 comprises a hollow tubular channel with an opening 142 parallel to the conduit axis. Through opening 142, power and data cables 141 may be inserted into cord manager 140 for concealment from view. Cord manager 140 is attached to system 20 between a wall tile 34 and edge cap 36. A tubular sidewall 144 is slidingly interfit between wall tile 34 and edge cap 36 so that cord manager 140 is parallel to seam 41 between edge caps 36. Cord manager may be constructed in different colors and could be wrapped in wall tile covering fabric so that it visually blends with an associated wall tile 34.

In operation, the work space management system 20 of the present invention is installed into an office environment as follows. A desired size of wall tile 34 is selected then lower track 32 is attached to existing wall 22 parallel to floor 26 at a selected position. Mounting holes 84 are drilled into the v-shaped grooves 82 at selected positions to permit a fastener screw 95 to be inserted and then attached to fastener 94 which has been installed into wall 22 and stud 24. Each connecting track 32 is attached to a previous track 32 by splice plate 86 in either a butt joint 85, inline connection 87 or mitered outside connection 89 depending upon the geometry of the fixed office walls 22. Splice plates 86 are inserted into connection passages 91 in each track 32 and bent if needed to accommodate the track joint required.

Track 30 is attached in the same manner to wall 22, a distance above track 32, for the proper engagement of wall tiles 34 to be inserted therebetween. Upper track 30 is also attached parallel to floor 26 and connecting to adjacent tracks 30 by splice plates 86.

Wall tiles 34 are measured and cut to substantially cover the area between tracks 30 and 32 allowing space for adjustment. Edge caps 36 are attached to vertical edges 38 of wall tiles 34 and quickly butted together by hand to create parallel seams 41 between wall tiles 34. In addition, at this time, slat tiles 56 may be installed as desired. Also at this time, supple cloth blinder 44 is inserted within channel 64 to conceal the interior of tracks 30 and 32 and to create a visually appealing trim.

Overhead brackets 50 are attached to track 30 at desired locations for placement of modular furniture units 52. Modular furniture units 52, with attached hook members 110, may now be hooked into and attached through hollow channel 112 in hitch member 108 of bracket 50. Cord managers 140 may be used to visually conceal electric and data cords 141 routed vertically between overhead storage units 52 and work surfaces 42. The cord manager 140 is slipped behind edge cap 36 on wall tile 34. Electric and data cables 141 are then routed through cord manager 140.

Work surface brackets 40 are now attached to track 32 at locations to support work surfaces 42 and provide connections adjacent work surfaces 42. After the work surface brackets 40 have been properly located, work surfaces 42 may be field cut and adjusted into a desired orientation and attached to work surface brackets 40.

At this time, the open office partition panels may be attached to tracks 30 and 32. First a properly sized starter channel 120 is selected and bolts 124 are inserted therethrough and loosely threaded into oblong retainers 126. Oblong retainers 126 are inserted and disposed within channel 64 behind upper and lower front edges 76 and 78. Bolts 124 are tightened causing oblong retainers to rotate clockwise approximately ¼ turn. Continued tightening of bolt 124 causes the starter channel 120 to clamp tightly to tracks 30 and 32. Transition panel 122 is attached to panel 60 by PANEL CONNECTION BRACKETRY at the top and bottom. Next, the transition panel 122 is inserted and screw 129 attached to starter channel 120, to complete the panel unit 62. Panel unit 62 may be attached anywhere along the track and attached together in many configurations to meet the needs of the office.

Any power or data cables 141 may be routed into a bottom panel raceway 123 from between wall tiles 34 or tracks 30 and 32 to as needed. Cables 141 are more conveniently routed to positions in the center of the office through raceway 123 than by routing under carpets or through suspended ceilings (FIGS. 18 and 19).

As shown in FIG. 18, a model office floor plan is presented showing a number of panels 62 attached together to fixed wall 22. Each of the fixed office spaces 150 along with the open office space 160 are shown using the work space partition system 20 of the present invention. Work surfaces 42 and overhead storage compartments 52 are hung in both the fixed office spaces 150 and in the office constructed within open office space 160. Power and data cables 141 are routed to the center of open office space 160 through panel unit 60.

The work space management system 20 is now operational to allow office personnel to complete their necessary functions. If a change in business conditions or a change in office personnel require a new office configuration, it is now possible to quickly and easily change and adapt the work space partition system to meet their work space needs. Since work surfaces 42 and modular furniture units 52 are attached to tracks 30 and 32 by brackets, they may be removed or relocated to any required track location. Furniture units may be attached to different locations on panels 62 by brackets 121. Detachment of panel unit 60 is also easy by simply removing screws and separating transition panel 122 from starter channel 120 and loosening bolts 124 until oblong retainers 126 can be rotated approximately ¼ turn counter-clockwise and extracted from channel 64. In this way, total utilization of office work space is attained quickly and inexpensively.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A work space partition system for defining a work area, said system comprising:

an existing permanent wall standing substantially vertical relative to a floor;

a first elongate mounting track attached generally horizontally to said wall;

a second elongate mounting track attached generally horizontally on said wall below said first track;

a wall tile is disposed between said tracks, said wall tile having vertical edges;

a movable office partition panel supported by said floor, said panel attached substantially perpendicular to at least one said track at a variably selectable position therealong for defining and partitioning said work area; and at least one modular furniture unit mounted to and supported by one of said track and said panel.

2. The system of claim 1 in which said office partition panel is positionable anywhere along said track.

3. The system of claim 1 in which said office partition panel is attached by a fastener connected to a retainer slidingly disposed within said track.

4. The system of claim 1 in which said track comprises:

a rectangular channel having an upper edge and a lower edge connected by a back wall, upper and lower face surfaces parallel to said back wall attached to a respective upper and lower edge, guide portions attached to said upper and lower edges, said guide portions disposed within said channel intermediate said face surface and said back wall forming a connection passage.

5. The system of claim 4 further comprising a concealment strip disposed within said channel, said concealment strip comprising a flat, supple, cloth-like material that is hand inserted into said channel.

6. The system of claim 4 further comprising a connecting means for connecting two said tracks together, said connecting means disposed within a said respective connection passage of each track.

7. The system of claim 1 further comprising:

a plurality of modular furniture units including work surface units and storage units, said furniture units including a task lighting unit with an electric cord;

mounting means for attaching said furniture units to said system, said storage unit attaching to said first track and said work surface unit attaching to said second track; and a cord manager formed from a conduit attached vertically to said tile for concealing said electric cord.

8. The system of claim 7 in which said cord manager is attached to said tile by a web of material interfit onto an edge of said tile.

9. A work space partition system for defining work areas, said system comprising:

an existing permanent wall standing substantially vertical relative to a floor;

at least two mounting tracks attached generally horizontally on said wall;

a wall tile disposed between said tracks, said tile covering said wall;

a movable office panel supported vertically on said floor;

means for connecting said panel to said tracks, said panel attached substantially perpendicular to said track at a variably selectable position therealong for defining and partitioning said work areas;

a plurality of modular furniture units; and mounting means for attaching said furniture units to said system whereby said modular furniture units may mount alternatively on said track and said panel.

10. The system of claim 9 in which said mounting track includes a top edge and a bottom edge, and said mounting means comprises a bracket with an flange portion for engaging said bottom edge and an opposing anti-dislodgement tang slid behind said top edge, whereby said bracket may not be separated from said track by only vertical movement.

11. The system of claim 10 in which said furniture units removably hook on to said brackets.

12. A work space partition system for defining work areas, said system comprising:

an existing permanent wall substantially vertical relative to a floor;

at least two mounting tracks attached generally horizontally on said wall;

at least two wall tiles having vertical edges, said tiles disposed between said tracks and covering said wall, said tiles defining a seam between themselves;

U-shaped edge caps covering said wall tile vertical edges, said edge caps slip-fit and adjustable on said wall tile vertical edges whereby said edge caps cover irregular wall tile edges to create parallel seams between said tiles, a panel supported vertically on said floor;

means for connecting said panel to at least one of said tracks, said panel attached substantially perpendicular to said track at a variably selectable position therealong for defining and partitioning said work areas;

a plurality of modular furniture units; and mounting means for attaching said furniture units to said system whereby said modular furniture units may mount alternatively on said track and said panel.

13. The system of claim 12 in which said mounting track includes a top edge and bottom edge, and said mounting means comprises a bracket with a flange portion for engaging said bottom edge and an opposing anti-dislodgement tang slid behind said top edge, whereby said bracket may not be separated from said track by only vertical movement.

14. A work space partition system for defining work areas, said system comprising:

an existing permanent wall substantially vertical relative to a floor;

at least two mounting tracks attached generally horizontally on said wall, each said track including a top edge and a bottom edge;

a wall tile disposed between said tracks, said tile covering said wall;

a plurality of modular furniture units, said plurality of units including work surface units and storage units;

mounting means connected to said track for attaching said furniture units to said track, said mounting means includes a plate having a flange to engage said bottom edge of a said track and an anti-dislodgement tang disposed behind said top edge, such that removal of said mounting means from said track by only vertical movement is prevented;

a panel arranged vertically on said floor; and means for connecting said panel to at least one of said tracks, said panel attached substantially perpendicular to said track at a selected position for defining and partitioning said work areas.

* * * * *